United States Patent [19]

Michiels

[11] 4,407,031

[45] Oct. 4, 1983

[54] ELASTOMER MATTRESS WITH STIFFENER ELEMENTS

[76] Inventor: August Michiels, Duprestraat 123, B-1090 Jette-Brussels, Belgium

[21] Appl. No.: 223,147

[22] Filed: Jan. 7, 1981

[30] Foreign Application Priority Data

Jan. 11, 1980 [BE] Belgium ..... 198934

[51] Int. Cl.[3] ..... A47C 27/16

[52] U.S. Cl. ..... 5/462; 5/481

[58] Field of Search ..... 5/481, 462, 464, 448; 397/DIG. 1

[56] References Cited

U.S. PATENT DOCUMENTS

| | | | |
|---|---|---|---|
| 2,836,228 | 5/1958 | Dahle | 5/481 |
| 2,898,975 | 8/1959 | Wagner | 5/481 |
| 3,110,042 | 11/1963 | Slemmons | 5/462 |
| 4,207,636 | 6/1980 | Ceriani | 5/481 |

FOREIGN PATENT DOCUMENTS

| | | | |
|---|---|---|---|
| 18046 | 10/1980 | European Pat. Off. | 5/462 |
| 2742397 | 3/1979 | Fed. Rep. of Germany | 5/481 |
| 709641 | 5/1931 | France | 5/481 |
| 2037155 | 7/1980 | United Kingdom | 5/481 |

*Primary Examiner*—Alexander Grosz
*Attorney, Agent, or Firm*—David S. Fishman

[57] ABSTRACT

An improved mattress is presented having upper and lower elastomer sheets with an undulating structure of elastomer elements housed between the sheets and containing stiffener elements in the elastomer elements.

7 Claims, 2 Drawing Figures

ELASTOMER MATTRESS WITH STIFFENER ELEMENTS

BACKGROUND OF THE INVENTION (1) Field of the Invention

The present invention relates to mattresses and particularly to foam mattresses with improved elastic properties. More specifically, this invention is directed to facilitating the manufacture of mattresses from elastomer materials and especially to the manufacture of reinforced foam mattresses. Accordingly, the general objects of the present invention are to provide novel and improved articles and methods of such character.

(2) Description of the Prior Art

Mattresses fabricated from elastomer materials, generally referred to as "foam" mattresses, are well known in the art. These prior foam mattresses, while enjoying significant commercial success, are known to possess certain deficiencies including, but not limited to, a tendency to permanently deform with continuous use. Prior "foam" mattresses are also often lacking in elasticity and thus resistance to deformation and, in use, sometimes fail to adapt well to the contour of the user's body or providing the proper support. Examples of prior art foam mattresses may be found in Belgian Pat. Nos. 775,631 and 873,825.

SUMMARY OF THE INVENTION

The present invention overcomes the above-discussed and other deficiencies and disadvantages of the prior art by providing a novel and improved method for assembling mattresses comprised of elastomer material and mattresses resulting from the practice of such method. In accordance with the present invention the interior structure of the mattress, in a first embodiment, is defined by abutting individually formed elastomer cylinders. In a second embodiment the interior structure consists of a pair of abutting continuous layers of elastomer. Those inner layers, in the outwardly facing direction, are each provided with a surface having an undulating, and preferably sinusoidal, contour. These contoured inner members are also preferably provided, on their facing abutting surfaces, with stiffener receiving cut-outs which are in registration.

BRIEF DESCRIPTION OF THE DRAWING

The present invention may be better understood and its numerous objects and advantages will become apparent to those skilled in the art by reference to the accompanying drawing wherein like reference numerals refer to like elements in the two FIGURES and in which.

DESCRIPTION OF THE PREFERRED EMBODIMENT

Figure 1:
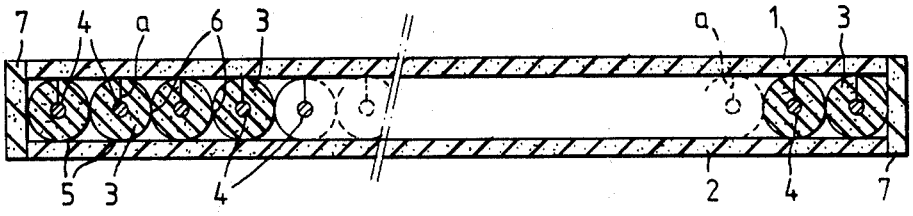
FIG. 1 is a cross-sectional side elevation view of a mattress in accordance with a first embodiment of the present invention.

FIG. 1 shows a foam mattress having highly desirable physical properties. The mattress of FIG. 1 is comprised of a pair of layers of 1 and 2 of elastomer which, in cooperation with the end pieces 7, define an inner chamber. Cylinders 3, which are also comprised of an elastomer, are disposed within this chamber in abutting relationship. The axes of the cylinders 3 will typically be oriented transversely of the longitudinal or head-to-foot axis of the mattress. The cylinders 3 are formed by rolling rectangular elastomer members so as to place opposite side surfaces in abutting relationship and securing the thus formed cylinders by means of a suitable adhesive or other technique; the abutting lines where the ends of the elastomer members are joined being indicated at "a". This technique of forming individual cylinders results in each cylinder being provided, on its axis, with a through hole. Stiffener elements, wooden rods 4 for example, are inserted in these through-holes.

After the cylinders 3 have been formed and the stiffener elements inserted therein, each cylinder is secured to at least one of the layers 1 and 2. In the mattress shown in FIG. 1, the cylinders 3 are secured to layer 2 by means of a flattened strip 5 formed by applying a compressive force to the cylinders. The method of attachment of the cylinders to the outer layer will typically consist of adhesive bonding. In addition to being compressed to form a flat which defines adequate surface area to securely bond the cylinder to at least one of the outer layers, the cylinders are compressed laterally to form the flattened regions indicated at 6 and adhesively secured to one another. As noted, the mattress is completed by the application of the end pieces 7. The fabrication procedure briefly described above produces a mattress which exhibits excellent elastic properties while providing ideal distribution and support of any weight imposed thereon. However, the production technique is quite lengthy with the formation of the cylinders 3 being particularly time-consuming.

Figure 2:
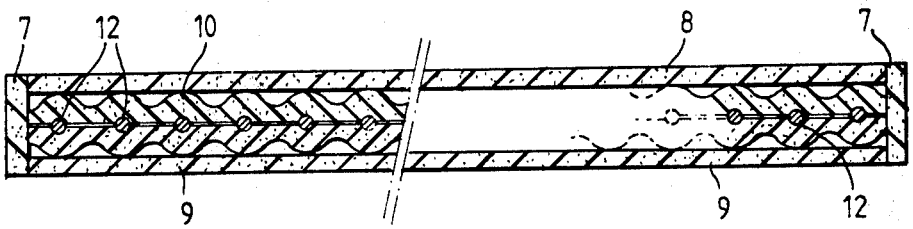
FIG. 2 is a cross-sectional side elevation view of a second embodiment of a mattress in accordance with the present invention.

Referring now to FIG. 2, a mattress which has physical properties which are at least comparable to those of the mattress of FIG. 1, and which can be assembled rapidly, is shown. The mattress of FIG. 2 also comprises the top and bottom elastomer layers 8 and 9 and the end pieces 7 which define an inner chamber. However, in the mattress of FIG. 2 the cylinders 3 are replaced by a pair of shaped elastomer layers 10 and 11. The elastomer layers 10 and 11 are formed, for example by cutting, from blocks of foam material having the desired characteristics are shaped such that one surface of each layer has a sinusoidal contour. On their opposite sides, in direct alignment with the "peaks" of the sinusoidal contour, the layers 10 and 11 are provided with cut-outs; these cut-outs being formed in flat faces of elastomer layers 10 and 11 and typically extending from one edge of the layer to the opposite edge. During the assembly procedure, the layers 10 and 11 are placed in abutting relationship with the flat faces thereof being in contact and the cut-outs in registration. The layers 10 and 11 are then secured to one another, for example through the use of a suitable adhesive, and the stiffeners 12 are inserted in the through-holes defined by the above-mentioned cut-outs. The stiffeners 12 may, for example, comprise wooden rods which have some flexibility. When fabrication of the inner member comprising the layers 10 and 11 and stiffeners 12 has been completed, this inner member may be easily sandwiched between the outer layers 1 and 2 and, typically, adhesively secured to the outer layers.

Thus, by cutting layers 10 and 12 by machine and securing these layers together via their abutting flat sides, an intermediate layer having the same response to loading as is exhibited by plural individual abutting cylinders is easily and inexpensively produced.

As will be understood by those skilled in the art, the mattresses of both of FIGS. 1 and 2, when completed by the attachment of the end pieces 7 thereto, will be fitted with a case or cover prior to being marketed.

As previously noted, the mechanical properties of the mattresses depicted in FIGS. 1 and 2 are in principle the same. However, because of its ease of assembly, the mattress of FIG. 2 comprises an improvement over the mattress of FIG. 1.

A mattress in accordance with the present invention is particularly well suited for use on a double bed since any difference in weight imposed on opposite sides may be taken up by the structure of the mattress. By way of example, when the difference in weight is more than 30 kg, the density of the elastomer foam in that part of the mattress which will be consistently exposed to the heavier weight can be increased. In the FIG. 2 embodiment, this may be done by forming the intermediate assembly comprised of the layers 10 and 11 in two pieces and, if this is done, movements which cause deformation in one half of the mattress will not have any effect on the other half. Similarly, the stiffening elements 4 or 12, which have been discussed above as being comprised of wood, may be replaced by other materials and elements having different physical characteristics may be inserted from each end thereby altering the response to the loading of the two halves of the mattress so that such response is dissimilar from one side to the other.

While a mattress in accordance with the present invention is preferably formed from a polyurethane synthetic foam, other materials having the same or similar properties may be employed. Similarly, while the layers 10 and 11 may be formed by machining blocks of foam, these members may also be produced by other methods such as by extruding or molding.

It is also to be noted that, while the above description refers to affixing the various components to one another as required through the use of suitable adhesives, other fastening techniques may be employed.

Thus, while a preferred embodiment has been shown and described, various modifications and substitutions may be made thereto without departing from the spirit and scope of the present invention and, accordingly, it is to be understood that the present invention has been described by way of illustration and not limitation.

What is claimed is:

1. In a mattress comprising a pair of spacially displaced elastomer sheets, said sheets cooperating with end members to define a chamber having a longitudinal axis and being of substantially constant depth between said sheets, the improvement comprising:

inner members disposed within said chamber, said inner members being comprised of elastomeric material and extending generally transverse to the longitudinal axis of the chamber, said inner members defining a pair of oppositely disposed surfaces having an undulating contour, said undulating surfaces contacting the inwardly facing surfaces of said sheets in a plurality of spacially displaced regions which extend between said end members, the regions of maximum height on each of said inner member undulating surfaces lying in planes which are substantially transverse to the chamber axis, said inner members further including stiffener elements contained therein and extending in a direction transverse to said chamber axis.

2. The mattress of claim 1 wherein said inner member is comprised of a pair of shaped elastomer layers, said layers each having a first surface which defines a sinusoidal contour and a second oppositely disposed surface which is substantially flat, and flat surface of said layers of said pair being in abutting relationship and said layers of said pair being joined together to form an integral inner member, and said flat surfaces each having a plurality of aligned recesses to house said stiffener elements.

3. The mattress of claim 2 wherein said layers of said pair are adhesively bonded at said abutting surfaces.

4. The mattress of claim 1 wherein said inner member is comprised of a plurality of abutting cylinders formed from panels of elastomeric material, each of said cylinders being bonded to the adjacent cylinders and to at least one of said elastomer sheets.

5. The mattress of claim 4 wherein said cylinders are compressed to define flattened regions and are bonded to each other and to the elastomer sheets in said flattened regions.

6. The mattress of claim 5 wherein said cylinders are formed with axial openings and said stiffeners are inserted in said openings.

7. The mattress of claim 3 wherein said recesses extend in the direction of and are aligned with the areas of maximum height of the undulations.

* * * * *